US007723655B2

(12) United States Patent
Kim

(10) Patent No.: US 7,723,655 B2
(45) Date of Patent: May 25, 2010

(54) MICROWAVE OVEN USING BAR CODE AND METHOD FOR CONTROLLING THE SAME

(75) Inventor: Kwang Keun Kim, Yongin-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 11/362,921

(22) Filed: Feb. 28, 2006

(65) Prior Publication Data

US 2006/0289508 A1 Dec. 28, 2006

(30) Foreign Application Priority Data

Jun. 27, 2005 (KR) ..... 10-2005-0055692

(51) Int. Cl.
*H05B 6/50* (2006.01)
*H05B 6/80* (2006.01)

(52) U.S. Cl. ..... 219/714; 219/725

(58) Field of Classification Search ..... 219/714, 219/702, 720, 506; 99/325, 451; 700/211
See application file for complete search history.

(56) References Cited

U.S. PATENT DOCUMENTS

| | | | | |
|---|---|---|---|---|
| 4,323,773 | A | 4/1982 | Carpenter | |
| 5,426,280 | A | 6/1995 | Smith | |
| 6,124,583 | A | 9/2000 | Bowers | |
| 6,249,710 | B1 | 6/2001 | Drucker | |
| 2002/0059175 | A1 * | 5/2002 | Nakano | 707/1 |

FOREIGN PATENT DOCUMENTS

| | | | |
|---|---|---|---|
| CN | 1576722 | | 2/2005 |
| EP | 0 550 124 | | 7/1993 |
| EP | 1 501 336 | | 1/2005 |
| GB | 2 300 053 | | 10/1996 |
| GB | 2 359 148 | | 8/2001 |
| JP | 1-285714 | * | 11/1989 |
| JP | 2-121294 | | 5/1990 |
| JP | 8-291914 | | 11/1996 |
| JP | 9-329339 | | 12/1997 |
| JP | 2002-022177 | | 1/2002 |
| JP | 2002-156117 | | 5/2002 |
| JP | 2002-243161 | * | 8/2002 |

(Continued)

OTHER PUBLICATIONS

U.S. Appl. No. 10/872,440, filed Jun. 22, 2004, Yun-Bong Chun, Samsung Electronics Co., Ltd.

(Continued)

*Primary Examiner*—Daniel L Robinson
(74) *Attorney, Agent, or Firm*—Staas & Halsey LLP

(57) ABSTRACT

A microwave oven cooking food using a bar code, and a method controlling same. The microwave oven comprises a bar code scanner for obtaining bar code data from the bar code attached to the food; and a controller for obtaining cooking data corresponding to the microwave oven from the bar code data, setting cooking conditions based on the obtained cooking data, and performing the cooking of the food according to the set cooking conditions. Accordingly, it is possible to develop cooking sets regardless of the manufacturing times of foods, and food producers can put foods applied compatibly to plural cooking sets on the market and easily control inventory.

6 Claims, 9 Drawing Sheets

FOREIGN PATENT DOCUMENTS

| | | |
|---|---|---|
| JP | 2005-043045 | 2/2005 |
| KR | 10-1997-47206 | 7/1991 |
| KR | 10-1999-60392 | 7/1999 |

OTHER PUBLICATIONS

U.S. Appl. No. 11/482,927, filed Jul. 10, 2006, Yun-Bong Chun, Samsung Electronics Co., Ltd.

U.S. Appl. No. 11/482,928, filed Jul. 10, 2006, Yun-Bong Chun, Samsung Electronics Co., Ltd.

Chinese Second Office Action issued with respect to Chinese Patent Application No. 200610071710.9, which corresponds to the above-referenced application.

Japanese Office Action issued with respect to Japanese Patent Application No. 2006-064879, which corresponds to the above-referenced application.

Office Action issued in corresponding Chinese Patent Application No. 200610071710.9 on Jul. 6, 2007.

Japanese Office Action for corresponding Japanese Patent Application No. 2006-064879 dated Nov. 4, 2008 (2 pgs).

European Search Report issued in corresponding European patent application No. 06004661.2.

* cited by examiner

MICROWAVE OVEN USING BAR CODE AND METHOD FOR CONTROLLING THE SAME

CROSS-REFERENCE TO RELATED APPLICATIONS

This application claims the benefit of Korean Patent Application No. 10-2005-55692, filed Jun. 27, 2005, in the Korean Intellectual Property Office, the disclosure of which is incorporated herein by reference.

BACKGROUND OF THE INVENTION

1. Field of the Invention

The present invention relates to a microwave oven which scans data from a bar code attached to food and cooks the food based on the scanned data of the bar code, and more particularly, to a microwave oven which obtains proper cooking data suitable thereto using data stored in the bar code according to different cooking sets, and obtains cooking data stored in a main body thereof when the cooking data of the corresponding microwave oven are not stored in the bar code, and a method for controlling the microwave oven.

2. Description of the Related Art

A microwave oven which cooks food using a bar code attached to the food is known in the art. The bar code includes cooking data, thus decreasing the user inconvenience of separately setting cooking conditions.

A conventional cooking apparatus using a bar code has the same cooking data regardless of the kind or size of the cooking apparatus. This conventional cooking apparatus is disadvantageous in that the cooking apparatus cannot obtain the optimum cooking data according to the kind or size of the cooking apparatus. Further, although the conventional cooking apparatus has different cooking data according to the kind or size of the cooking apparatus, when a new cooking set is developed and enters the market, the newly developed cooking set cannot perform the proper cooking of food based on the data obtained from the bar code attached to the food. That is, the kind of food, which is optimally cooked by the cooking set, is limited.

SUMMARY OF THE INVENTION

Additional aspects and/or advantages of the invention will be set forth in part in the description which follows and, in part, will be apparent from the description, or may be learned by practice of the invention.

Therefore, an aspect of the present invention is to provide a microwave oven using a bar code, which receives optimum cooking data according to a kind or a volume of the microwave oven, and appropriately cooks not only currently available food but also food, which may enter the market after the manufacture of the microwave oven, and a method of controlling the microwave oven.

In accordance with an aspect, the present invention provides a microwave oven cooking food using a bar code, comprising: a bar code scanner obtaining bar code data from the bar code attached to the food; and a controller obtaining cooking data corresponding to the microwave oven from the bar code data, setting cooking conditions based on the obtained cooking data, and performing the cooking of the food according to the set cooking conditions.

The microwave oven may further comprise a memory storing cooking data of foods corresponding to the microwave oven, wherein, when the controller does not obtain the cooking data corresponding to the microwave oven from the bar code data, food data are obtained from the bar code data, the cooking data corresponding to the obtained food data are obtained from the memory, and the cooking of the food is performed based on the obtained cooking data.

The bar code may comprise a plurality of cooking data according to kind and volume of the microwave oven.

The bar code may further comprise a food ID code.

In accordance with another aspect, the present invention provides a method of controlling a microwave oven for cooking food using a bar code comprising: obtaining bar code data by scanning the bar code; determining whether the obtained bar code data includes cooking data of the corresponding microwave oven; obtaining the cooking data when it is determined that the bar code data include the cooking data of the corresponding microwave oven; and performing the cooking of the food based on the obtained cooking data.

In accordance with yet another aspect, the present invention provides a method of controlling a microwave oven for cooking food using a bar code comprising: obtaining bar code data by scanning the bar code; determining whether the obtained bar code data includes cooking data of the corresponding microwave oven; obtaining food ID data from the bar code data when it is determined that the bar code data do not include the cooking data of the corresponding microwave oven; obtaining the cooking data of the corresponding food, stored in a memory of a main body of the microwave oven, using the food ID data; and performing the cooking of the food based on the obtained cooking data.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
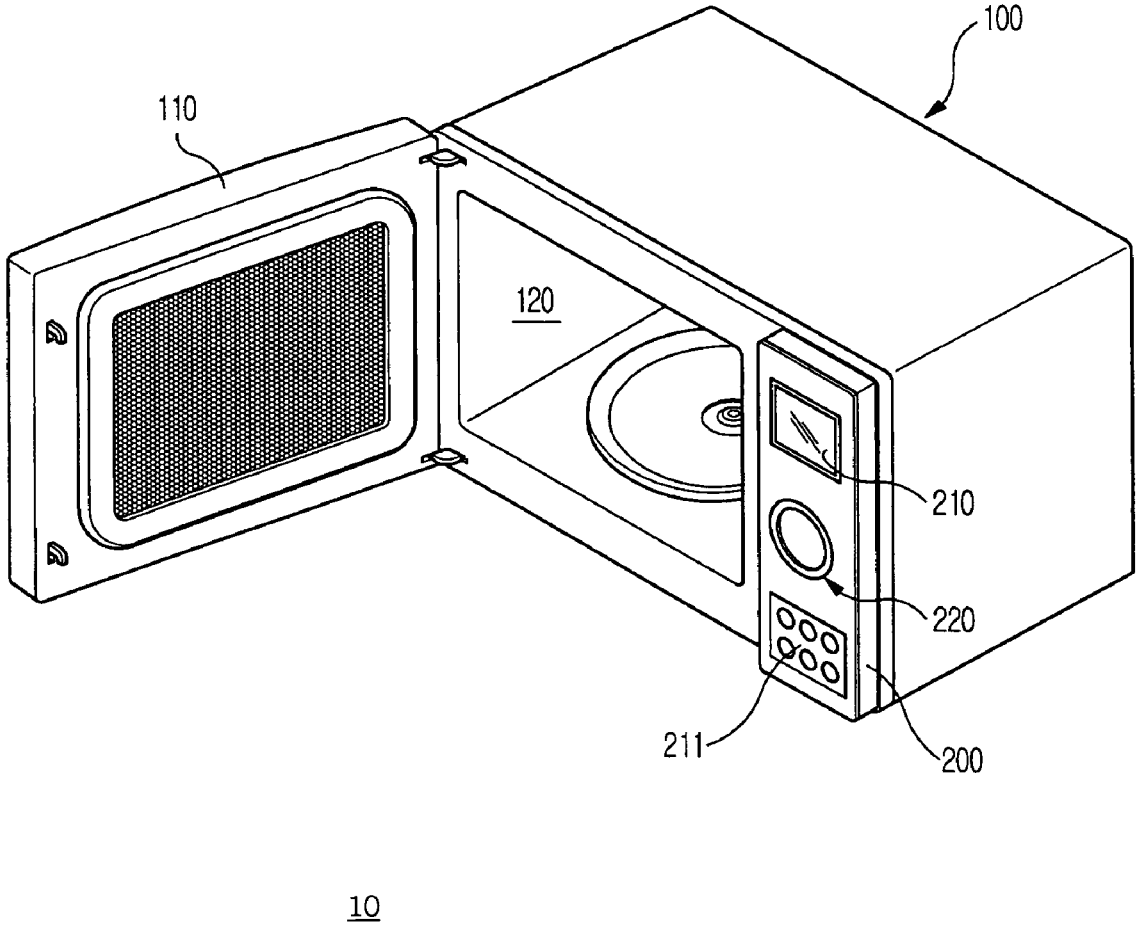
FIG. 1 is a perspective view of a microwave oven in accordance with the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

As shown in FIG. 1, a cooking set 10, i.e., a microwave oven 10, in accordance with the present invention comprises a main body 100 defining the external appearance thereof and provided with a cooking chamber 120 installed therein, and a door 110 and an operating panel 200 installed on the front surface of the main body 100.

The operating panel 200 comprises a display unit 210 displaying operating data for performing a cooking operation and operating state of the microwave oven 10, an input unit 211 allowing a user to input instructions set by a user, and a bar code scanner 220 scanning a bar code attached to a package of food.

Figure 2:
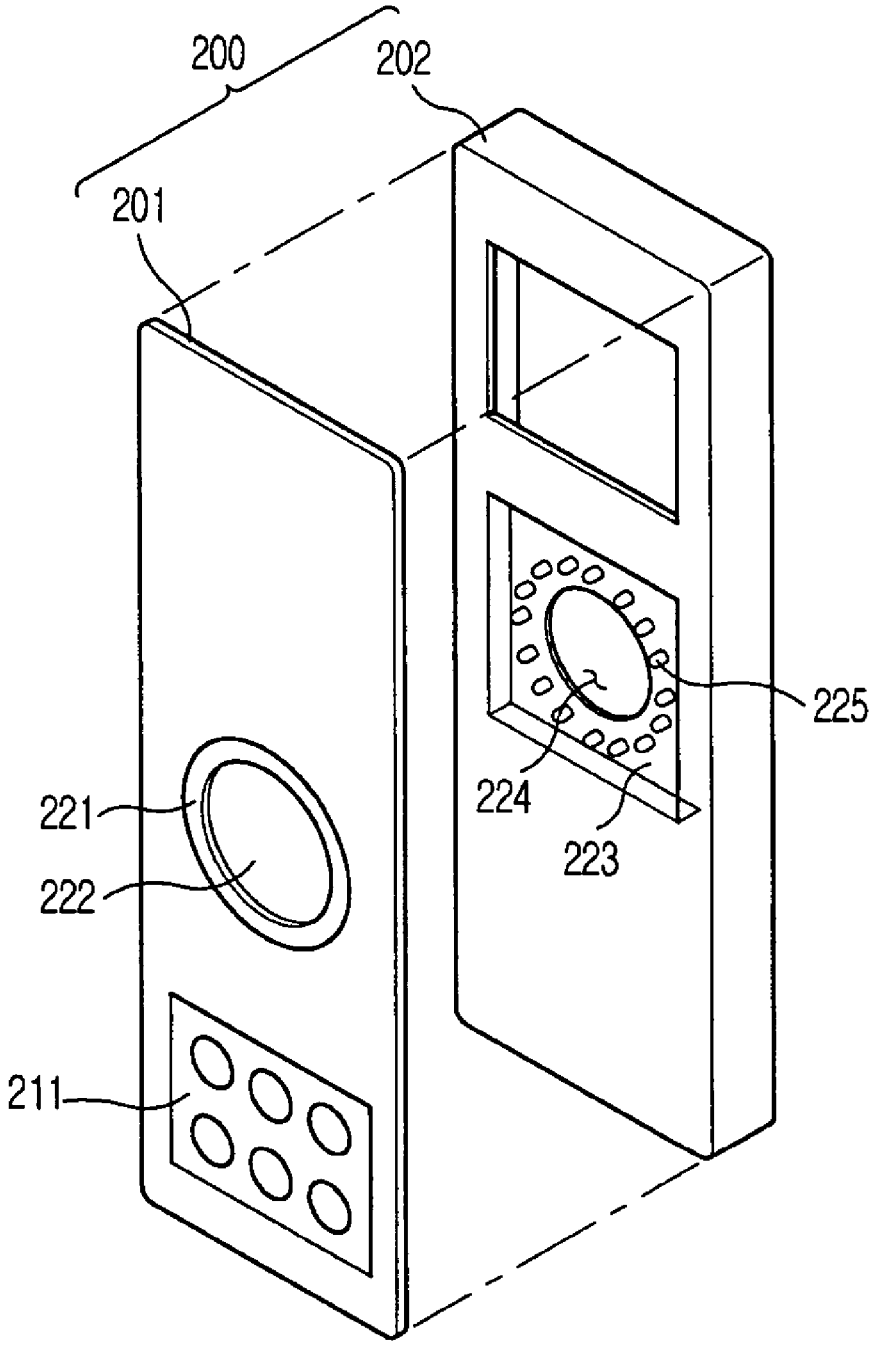
FIG. 2 is a perspective view of a bar code scanner of the microwave oven of FIG. 1.

The operating panel 200, as shown in FIG. 2, further comprises an outer case 201 and an inner case 202. The bar code scanner 220 comprises a window 222 fixed to the outer case 201 by a holder 221, a substrate 223 disposed in the rear of the window 222 and provided with a hole 224 formed through the central area thereof, and a plurality of infrared lamps 225 disposed in a circular shape on the substrate 223 for projecting infrared light through the window 222. A camera, which will be described later, is located in the rear of the hole 224. The camera serves to receive the image of the bar code reflected by the light.

Figure 3A:
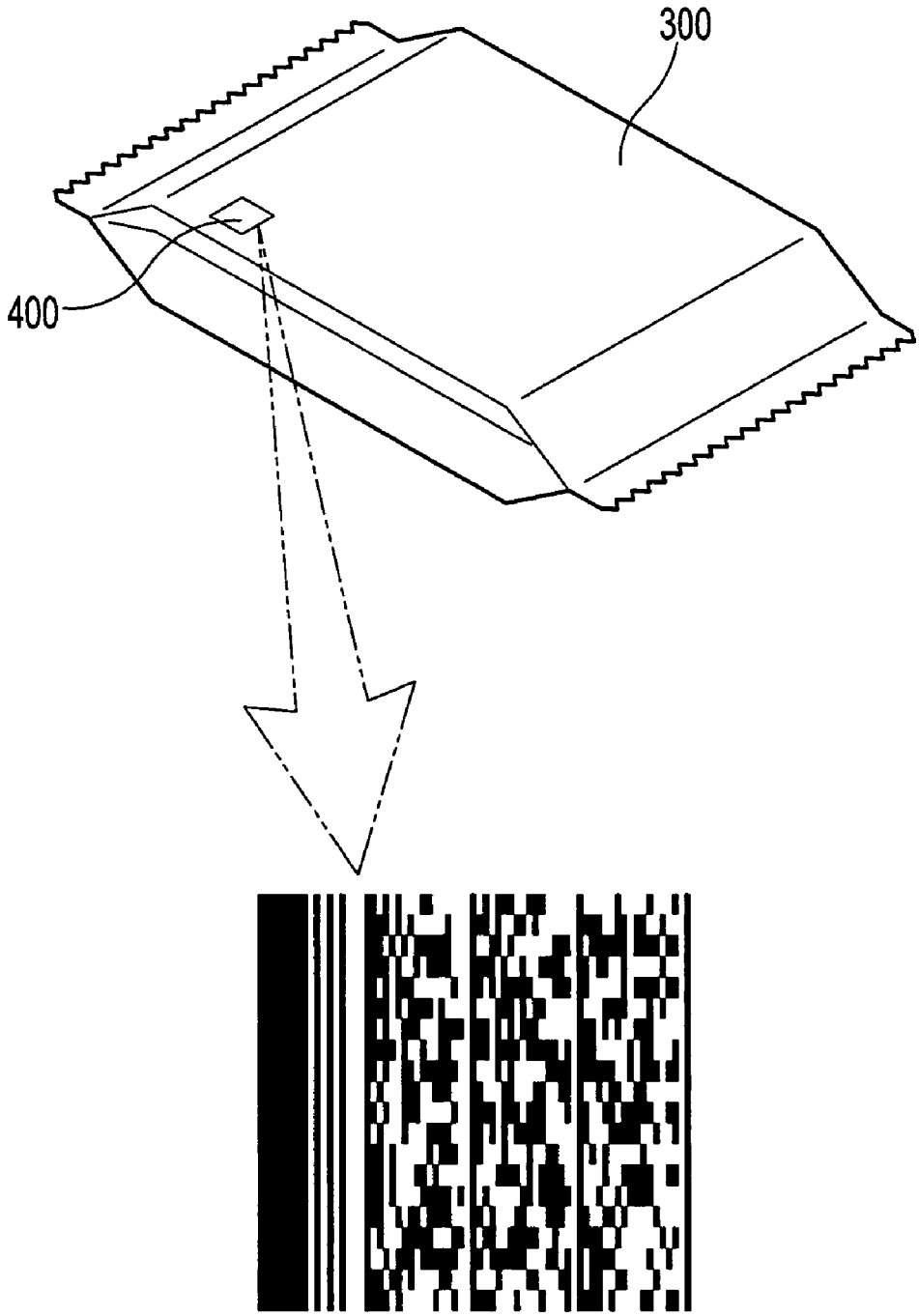
FIG. 3A is a view illustrating a two-dimensional bar code of a food applied to the present invention.
Figure 3B:
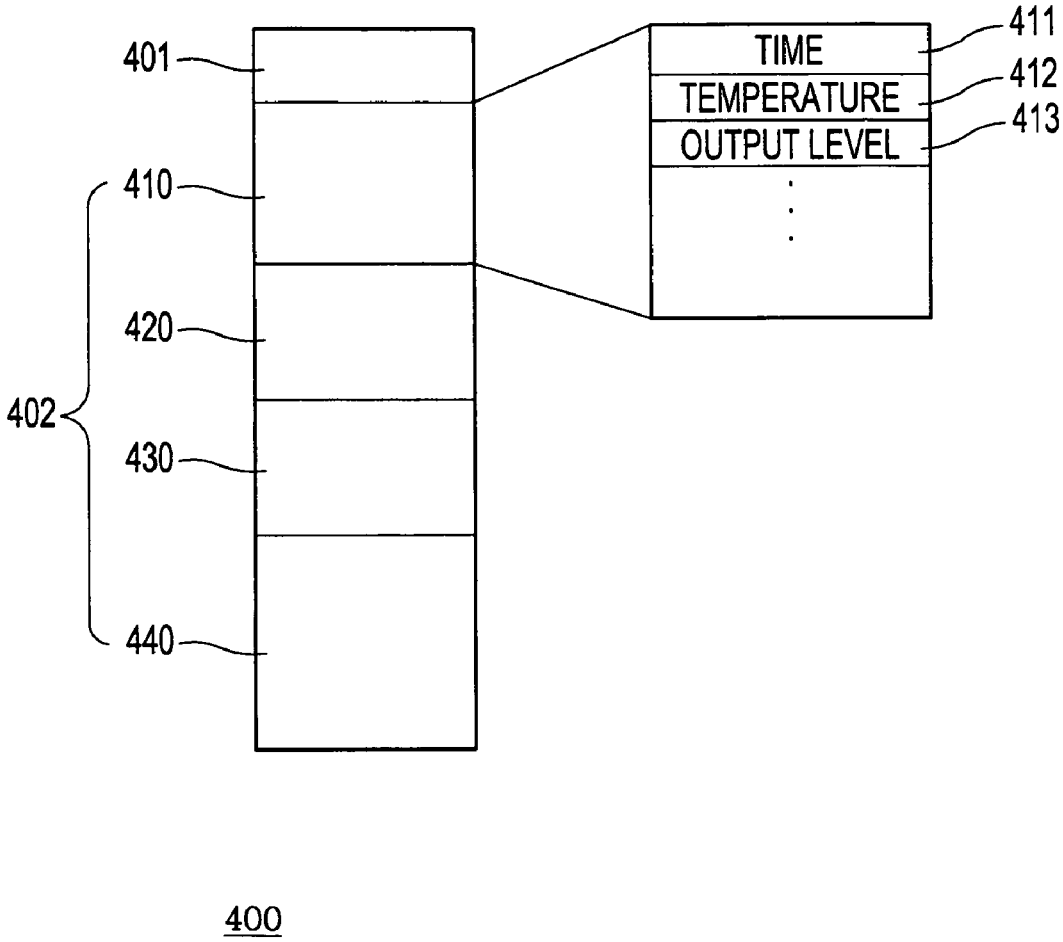
FIG. 3B is a view illustrating a system of the two-dimensional bar code of FIG. 3A.

FIG. 3A is a view illustrating a two-dimensional bar code attached to a package of a food applied to the present invention, and FIG. 3B is a view illustrating a system of the two-dimensional bar code of FIG. 3A. Hereinafter, cooking sets are microwave ovens, which have respectively cooking chambers with different volumes, thereby having different optimum cooking conditions of the same food. However, the present invention is not limited to cooking sets as microwave ovens.

A two-dimensional bar code 400 is attached to a package of an A1 food 300. Conventional bar codes are one-dimensional bar codes having small data capacity, thus being limited in their ability to provide detailed cooking data. In an embodiment of the present invention, the two-dimensional bar code 400 is applied to the present invention. The two-dimensional bar code 400 is a bar code in which data are expressed on a plane in the directions of X and Y axesThe two-dimensional bar code 400 also has a capacity for exhibiting cooking data corresponding to multiple cooking sets, i.e., plural microwave ovens 10. In an example of the two-dimensional bar code 400, the capacity of the two-dimensional bar code 400 is set to approximately 100 bytes.

The system of the two-dimensional bar code 400, as shown in FIG. 3B, comprises a common region 401 storing common code data, such as a food ID, and a cooking set region 402 storing cooking data regarding the plural cooking sets. Although this embodiment describes the cooking set region 402 having a size for storing cooking data of at most four cooking sets, the size of the cooking set region 402 is not limited thereto and is set according to the number of the cooking sets.

The cooking set region 402 stores cooking data for setting cooking conditions of the food in at least one cooking data region selected from first to fourth cooking data regions 410, 420, 430, and 440. For example, when only the first cooking set is an object for cooking the A1 food 300, the cooking data are stored only in the first cooking data region 410 of the cooking set region 402 of the two-dimensional bar code 400. The first cooking data region 410 comprises a time data region 411 storing data for setting the cooking time of the food, a temperature data region 412 storing data for setting the cooking temperature of the food, and an output level data region 413 storing data for setting the output level for cooking the food.

In the case that the second to fourth cooking sets are not yet developed, the cooking data regarding the second to fourth cooking sets are not set. Accordingly, the second to fourth cooking data regions 420, 430, and 440 do not store cooking data if the second to fourth cooking sets have not yet been developed.

Figure 4A:
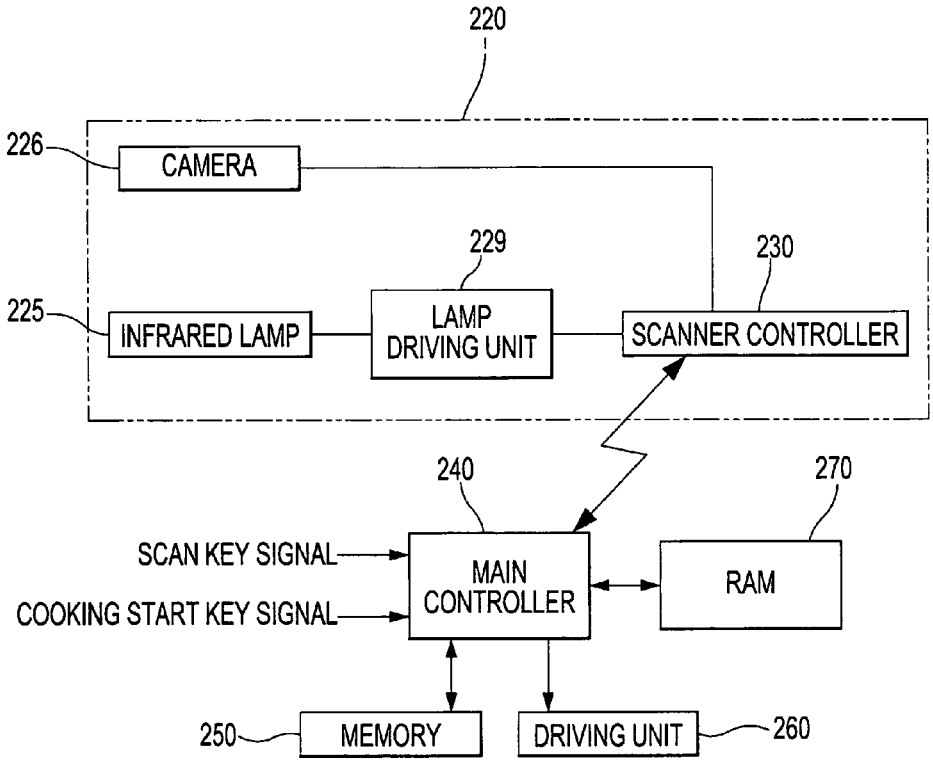
FIG. 4A is a block diagram of the microwave oven of the present invention.
Figure 4B:
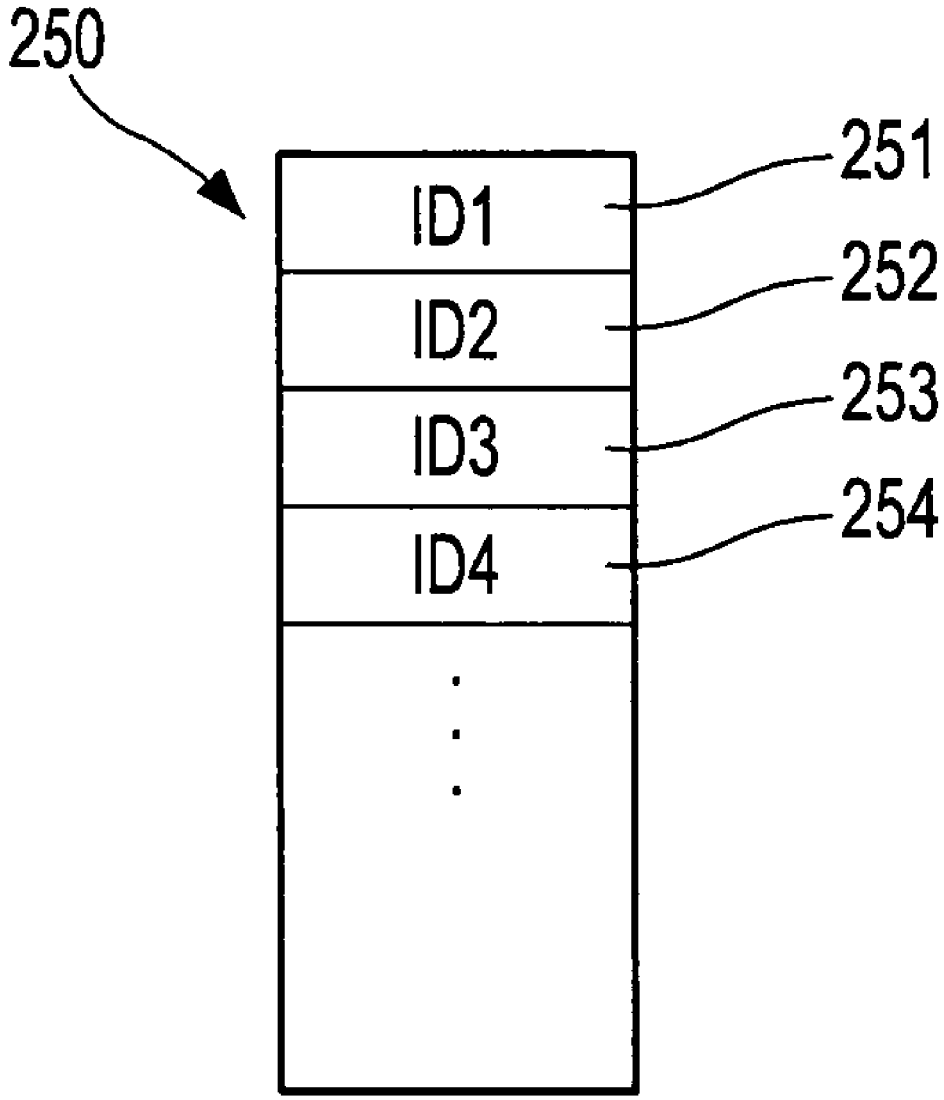
FIG. 4B is a view illustrating a system of a memory of the microwave oven of FIG. 4A.

FIG. 4A is a block diagram of the microwave oven 10 of the present invention. The microwave oven 10 comprises the bar code scanner 220 for scanning a bar code, and a main controller 240 controlling the overall operation of the microwave oven 10.

The bar code scanner 220 comprises scanner controller 230 controlling the bar code scanning operation. The scanner controller 230 controls lamp driving unit 229 so that the lamp driving unit 229 operates ultraviolet lamps 225, and controls a camera 226 so that the camera 226 supplies the image of the bar code to the scanner controller 230.

The scanner controller 230 interfaces to the main controller 240, thus transmitting and receiving control instructions regarding the scanning operation, and outputting a scan-ON signal and a scan-OFF signal for operating the lamp driving unit 229 according to the control instructions.

The lamp driving unit 229 turns on and off the plural infrared lamps 225 under the control of the scanner controller 230.

The lamp driving unit 229 turns on the plural infrared lamps 225 according to the scan-ON signal output by the scanner controller 230. In response, the infrared lamps 225 emit infrared light through the window 222 to an area in front of the operating panel 200. At this time, when the Al food 300 approaches the window 222, the emitted infrared light is reflected by the two-dimensional bar code 400 and is inputted to the camera 226, which is located in the rear of the window 222. The camera 226 outputs the image of the bar code 400 to the scanner controller 230, and the scanner controller 230 decodes the image of the bar code 400 and transmits the decoded image to the main controller 240.

The main controller 240 temporarily stores the decoded image of the bar code 400 in a RAM 270, and interprets the decoded image of the bar code 400. That is, the main controller 240 recognizes the ID of the Al food 300, which is stored in the common region 401 of the two-dimensional bar code 400, and, in the case that the cooking set region 402 stores cooking data regarding the corresponding microwave oven, recognizes the cooking data.

A memory 250 stores a cooking set identification code for identifying the corresponding microwave oven. In an embodiment of the present invention, a nonvolatile flash memory is used as the memory 250. The main controller 240 searches the memory 250, and determines which cooking set out of the first to fourth cooking sets the corresponding microwave oven belongs to.

In the case that the cooking data is recognized by interpreting the image of the bar code 400 of the A1 food 300, the main controller 240 sets cooking conditions for performing the cooking operation according to the recognized cooking data, and stores the set cooking conditions in the RAM 270.

Thereafter, when a user inputs a cooking start key signal to the microwave oven 10 through the input unit 211 under the condition that the A1 food 300 is placed in the cooking chamber 120 and the door 110 is closed, the main controller 240 controls the lamp driving unit 229 according to the set cooking conditions so that the lamp driving unit 229 drives loads (not shown), such as a magnetron and a circulation fan. Thereby, the cooking of the A1 food 300 is performed.

In the case that the cooking data regarding the cooking set are stored in a bar code, the cooking data regarding the corresponding cooking set are obtained, and then the cooking of the food in the cooking set is performed according to the cooking data. However, for example, in the case that the second to fourth cooking sets are not yet developed when the A1 food 300 enters the market, cooking data regarding the above cooking sets cannot be stored in the bar code 400 of the A1 food 300. Accordingly, the second to fourth cooking sets, which are improvements of the first cooking set, cannot directly obtain their cooking data from the two-dimensional bar code 400 of the A1 food 300, which is circulated on the market (since the second to fourth cooking data regions 420, 430, and 440 do not store the cooking data regarding the corresponding cooking sets). In consideration of the above fact, each of the memories 250 of the cooking sets, which are developed after the A1 food 300 enters the market, stores cooking data of foods, which enter the market before the development of the cooking sets, according to the IDs of the foods. The memory 250 comprises a plurality of food code regions 251, 252, 253, and 254, which are divided according to IDs of the foods. For example, the first food code region 251 stores the cooking data of the A1 food regarding the corresponding cooking set.

The two-dimensional bar code 400 stores data regarding foods, i.e., data regarding IDs of the foods, as well as cooking data of cooking sets. Accordingly, only when the two-dimensional bar code 400 does not store cooking data regarding the corresponding cooking set, the ID of the corresponding food is read (otherwise, the ID of the corresponding food may be read regardless of whether or not the two-dimensional bar code 400 stores cooking data regarding the corresponding cooking set). Under the above condition, for example, when the third cooking set scans the A1 food 300, since the bar code 400 of the food 300 does not store cooking data corresponding to the third cooking set, the third cooking set identifies the A1 food 300 by reading the food ID from the two-dimensional bar code 400. Here, the main controller 240 of the third cooking set searches the first food code region 251 of the memory 240 corresponding to the recognized A1 food 300, reads the cooking data from the first food code region 251, and temporarily stores the read cooking data in the RAM 270. Thereafter, the main controller 240 of the third cooking set sets the conditions for performing the cooking operation of the A1 food 300 according to the read cooking data, and stores the set cooking conditions in the RAM 270. Then, the main controller 240 controls the driving unit 260 according to the set cooking conditions, thereby performing the cooking of the A1 food 300.

Figure 5A:
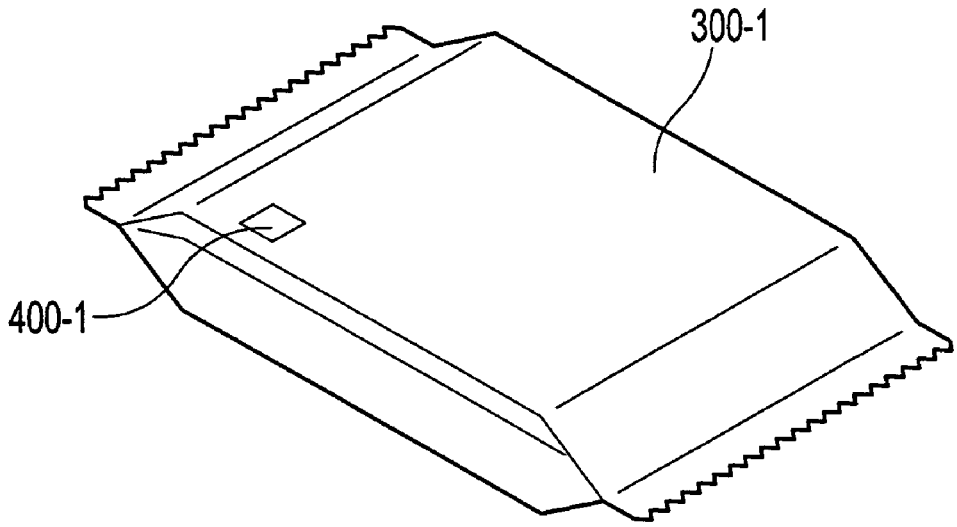
FIG. 5A is a view illustrating a two-dimensional bar code of another food applied to the present invention.

Further, an A2 food 300-1, which is an improvement of the A1 food, may enter the market under the condition that the A1 food is circulated on the market and the first and second cooking sets are developed. As shown in FIG. 5A, a two-dimensional bar code 400-1 is attached to the A2 food 300-1.

Figure 5B:
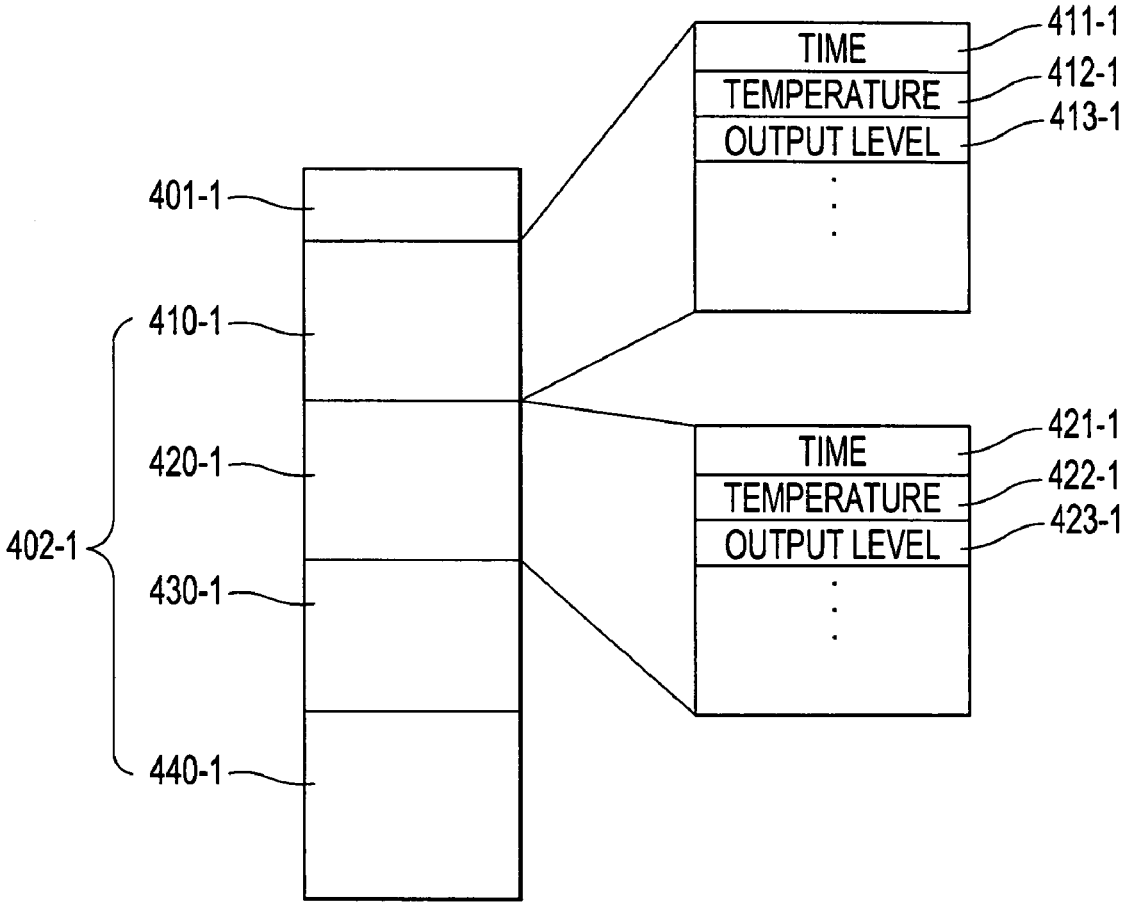
FIG. 5B is a view illustrating a system of the two-dimensional bar code of FIG. 5A.

The two-dimensional bar code 400-1 attached to the A2 food 300-1, as shown in FIG. 5B, comprises a common region 401-1 and a cooking set region 402-1. The cooking set region 402-1 comprises first to fourth cooking data regions 410-1, 420-1, 430-1, and 440-1. The first cooking data region 410-1 of the cooking set region 402-1 stores cooking data of the A2 food 300-1 corresponding to the first cooking set, and the second cooking data region 420-1 of the cooking set region 402-1 stores cooking data of the A2 food 300-1 corresponding to the second cooking set.

In the case that the first or second cooking set cooks the A2 food 300-1, the first or second cooking set obtains the corresponding cooking data from the two-dimensional bar code 400-1. Accordingly, the first or second cooking set sets cooking conditions, and performs the cooking of the A2 food 300-1 according to cooking start instructions.

The third and fourth cooking sets, which are developed after the A2 food enters the market, cannot obtain cooking data directly from the two-dimensional bar code 400-1 of the A2 food 300-1. In order to cook the A2 food 300-1 circulated in the market, the third or fourth cooking set identifies the A2 food 300-1 by reading a food ID of the A2 food 300-1 stored in the common region 401-1 of the two-dimensional bar code 400-1, searches cooking data from the food code region 252 of the memory 250 corresponding to the identified A2 food 300-1, and sets cooking conditions of the A2 food 300-1 according to the searched cooking data. Thereafter, the third or fourth cooking set cooks the A2 food 300-1 according to the set cooking conditions.

Hereinafter, the cooking process of the above-described microwave oven 10 will be described in detail with reference to the accompanying drawings. The case, that food ID data and cooking data corresponding to the cooking set are simultaneously read from a bar code when the bar code is scanned, and the case, that the cooking data corresponding to the cooking set are first read from the bar code and, when the cooking data corresponding to the cooking set are not stored in the bar code, the food ID data are read from the bar code by re-scanning the bar code, will be separately described.

Figure 6:
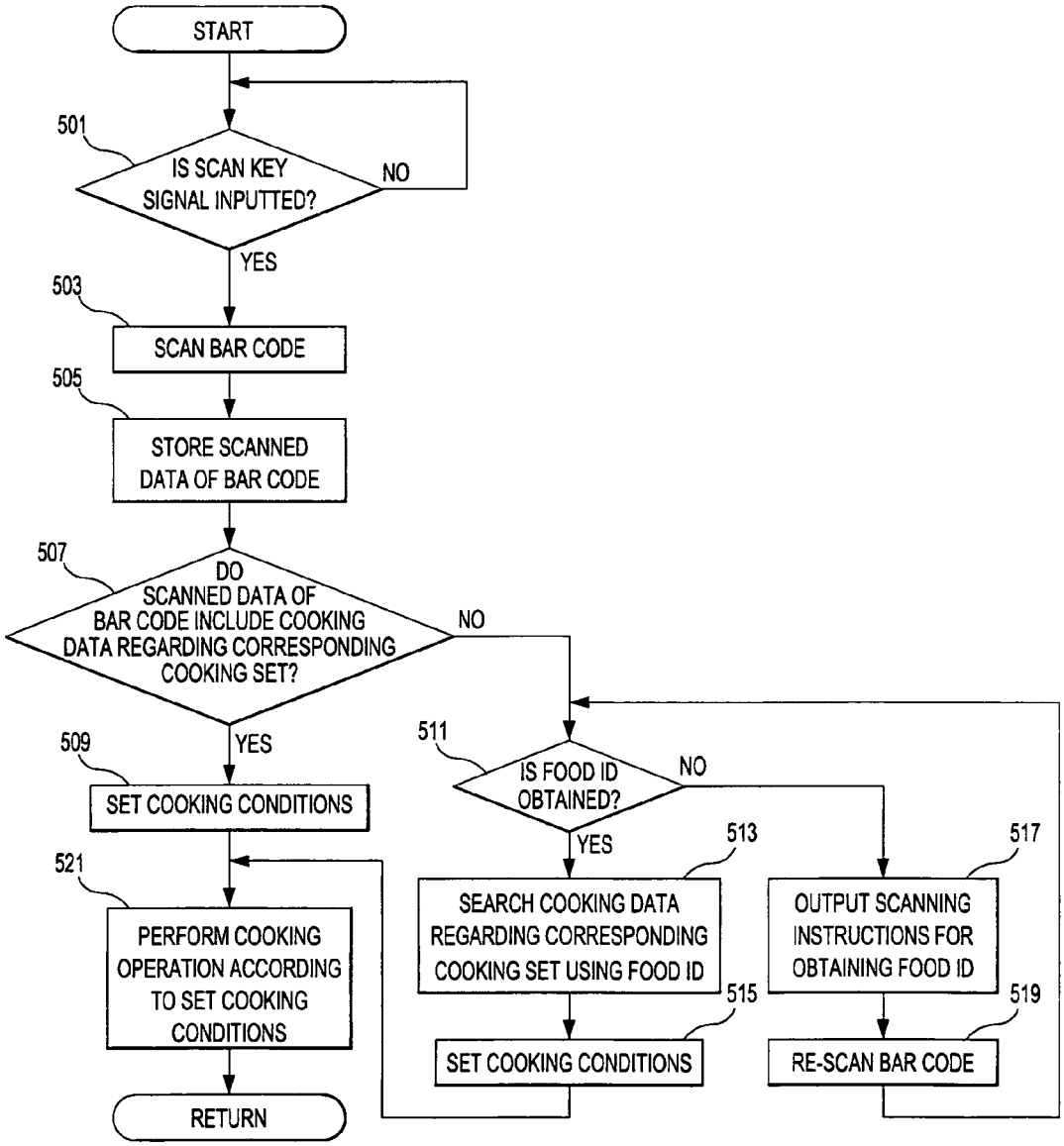
FIG. 6 is a flow chart illustrating a method for controlling a microwave oven using a bar code in accordance with the present invention.

With reference to FIG. 6, when power is switched on, the main controller 240 determines whether the scan key signal is inputted from the input unit 211 (501), and, when it is determined that the scan key signal is inputted, the main controller 240 supplies the scan-ON signal to the scanner controller 230. The scanner controller 230 controls the lamp driving unit 229 so that the lamp driving unit 229 turns on the infrared lamps 225. The infrared light emitted from the infrared lamps 225 is projected onto an area in front of the operating panel 200 through the window 222. At this time, when a food with a two-dimensional bar code approaches the window 222, the bar code scanner 220 scans the two-dimensional bar code (503).

When the bar code is scanned by the bar code scanner 220, the camera 226 inputs the image of the bar code to the scanner controller 230, and the main controller 240 stores the image of the bar code, transmitted from the scanner controller 230, in the RAM 270 (505).

The main controller 240 decodes the image of the bar code, and determines whether the scanned data of the bar code include cooking data regarding the corresponding cooking set (507). When it is determined that the scanned data of the bar code include the cooking data regarding the corresponding cooking set, i.e., when the cooking data regarding the corresponding cooking set can be obtained directly from the two-dimensional bar code, the main controller 240 sets cooking conditions according to the obtained cooking data (509).

On the other hand, when it is determined, as a result of step 507, that the scanned data of the bar code do not include the cooking data regarding the corresponding cooking set, the main controller 240 determines whether the scanned data of the bar code include food ID data, i.e., whether or not the food ID data together with the cooking data are obtained from the bar code when the bar code is scanned (511). When it is determined that the food ID data are obtained from the bar code, the main controller 240 searches the cooking data regarding the corresponding cooking set from the memory 250 using the obtained food ID data (513), and sets cooking conditions of the corresponding cooking set according to the searched cooking data (515).

On the other hand, when it is determined, as a result of operation 511, that the food ID data are not obtained from the bar code but only the cooking data are obtained from the bar code when the bar code is scanned, the main controller 240 outputs instructions for obtaining the food ID data to the scanner controller 230 (517). Thereby, the infrared lamps 225 of the bar code scanner 220 are operated to project infrared light, thereby re-scanning the bar code (519). Thereafter, operation 511 is carried out.

When the cooking conditions of the corresponding cooking set are set according to the cooking data obtained from the bar code in operation 509, or when the cooking conditions of the corresponding cooking set are set according to the cooking data searched from the memory 250 using the food ID data in operation 515, the main controller 240 controls the driving unit 260 according to the cooking conditions set in response to the cooking start key signal inputted through the input unit 211, thereby performing the cooking operation of the food (521).

As apparent from the above description, the present invention provides a microwave oven, which obtains cooking data from a two-dimensional bar code attached to a food, and optimally cooks the food based on the obtained cooking data, and a method for controlling the microwave oven. Particularly, when the microwave oven cannot obtain the cooking data regarding the corresponding microwave oven from the two-dimensional bar code of the food, which is distributed in the market, the microwave oven obtains the cooking data by searching a memory, installed therein, using an ID code of the food. Accordingly, it is possible to optimally cook foods even when a plurality of cooking sets have different cooking conditions, and to develop the cooking sets regardless of whether or not the foods, which separately enter the market, are manufactured. Further, food producers can put foods applied compatibly to plural cooking sets on the market, thereby easily controlling inventory.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A microwave oven, comprising:

a bar code scanner that scans bar code data from a bar code attached to a container containing food; and a controller that determines whether the bar code data includes cooking data for the microwave oven, sets cooking, including set cook time, conditions based on included cooking data and performs a cooking operation according to the set cooking conditions set based on the included cooking data, when the bar code data is determined to include cooking data for the microwave oven, and obtains food identification data from the bar code data, locates in and reads out from a memory cooking data, including a cook time, for the microwave oven based on the obtained food identification data, sets cooking conditions, including the read out cook time, and performs a cooking operation according to the set cooking conditions set based on the located cooking data, when the bar code data is not determined to include cooking data for the microwave oven, the set cook time being the same as the read out cook time.

2. The microwave oven as set forth in claim 1, wherein the bar code comprises a plurality of cooking data according to kind and volume of the microwave oven.

3. The microwave oven of claim 1, wherein the controller obtaining the cooking data from a 2-dimensional bar code.

4. A method for controlling a microwave oven cooking food using a bar code comprising:

scanning the bar code;

determining whether the bar code data includes cooking data for the microwave oven;

setting cooking, including set cook time, conditions based on included cooking data and performing a cooking operation according to the set cooking conditions set based on the included cooking data, when the bar code data is determined to include cooking data for the microwave oven; and obtaining food identification data from the bar code data, locating in and reading out from a memory cooking data, for the microwave oven based on the obtained food identification data, setting cooking conditions, including the read out cook time, and performing a cooking operation according to the set cooking conditions set based on the located cooking data, when the bar code data is not determined to include cooking data for the microwave oven, the set cook time being the same as the read out cook time.

5. The method as set forth in claim 4, wherein the bar code comprises a plurality of cooking data according to kind and volume of the microwave oven.

6. The method of claim 4, wherein the bar code data comprising 2-dimensional bar code data.

* * * * *